US005870006A

United States Patent [19]

Tada et al.

[11] Patent Number: 5,870,006

[45] Date of Patent: Feb. 9, 1999

[54] DIELECTRIC FILTER

[75] Inventors: Hitoshi Tada, Ishikawa-ken; Hideyuki Kato, Kanasawa, both of Japan

[73] Assignee: Murata Manufacturing Co., Ltd., Japan

[21] Appl. No.: 749,067

[22] Filed: Nov. 14, 1996

Related U.S. Application Data

[63] Continuation of Ser. No. 458,893, Jun. 2, 1995, abandoned.

[30] Foreign Application Priority Data

Oct. 13, 1994 [JP] Japan ..... 6-248022

[51] Int. Cl.[6] ..... H01P 1/202; H01P 1/20

[52] U.S. Cl. ..... 333/202; 333/206

[58] Field of Search ..... 333/202, 203, 333/206, 207, 222, 223, 202 DB

[56] References Cited

U.S. PATENT DOCUMENTS

| | | | |
|---|---|---|---|
| 4,983,938 | 1/1991 | Sasaki et al. | 333/207 |
| 5,365,209 | 11/1994 | Ito et al. | 333/206 |

FOREIGN PATENT DOCUMENTS

| | | | |
|---|---|---|---|
| 0444948 | 9/1991 | European Pat. Off. . | |
| 0538894 | 4/1993 | European Pat. Off. | 333/202 |
| 13801 | 1/1982 | Japan | 333/202 DB |
| 61-167201 | 7/1986 | Japan . | |
| 0278401 | 11/1988 | Japan | 333/202 |
| 4167701 | 6/1992 | Japan . | |
| 4-302503 | 10/1992 | Japan | 333/202 |
| 5-175703 | 7/1993 | Japan | 333/202 |
| 5175705 | 7/1993 | Japan | 333/206 |

*Primary Examiner*—Seungsook Ham

*Attorney, Agent, or Firm*—Ostrolenk, Faber, Gerb & Soffen, LLP

[57] ABSTRACT

For a BEF type dielectric filter, a plurality of one-stage band-elimination filters (BEFs) each composed of two resonant lines inter-digitally pair-coupled to each other, are provided within one dielectric block and phase-shifting-coupled to each other at an electrical angle of $\pi/2$ in an inter-digital or comb-line manner. In addition, an input or output resonant line is provided which is phase-shifting-coupled to an input or output resonant line of the BEF type dielectric filter at an electrical angle of $\pi/2$ in an inter-digital or comb-line manner.

8 Claims, 6 Drawing Sheets

DIELECTRIC FILTER

This is a Continuation of application Ser. No. 08/458,893, filed on Jun. 2, 1995 (now abandoned).

BACKGROUND OF THE INVENTION

1. Field of the Invention

The present invention relates to a dielectric filter, more particularly to a BEF type dielectric filter which is applicable, but not exclusively, to mobile communication apparatus and the like.

2. Description of the Prior Art

FIG. 7 illustrates a structure of a conventional one-stage band-elimination filter (which will be referred hereinafter to as a one-stage BEF), which includes two inter-digitally-coupled resonant lines. In FIG. 7, to form the one-stage BEF, λ/4 resonant lines 11*a*, 11*b* are inter-digitally coupled such that their open ends and short-circuit ends are arranged to be opposite in direction to each other in a dielectric block 20. Further, FIG. 8 shows its circuit arrangement, FIG. 9 illustrates an equivalent circuit, and FIG. 10 is a cross-sectional view, taken along line X—X of FIG. 7, showing how the equivalent circuit is formed.

In FIG. 10, unit length self-capacitances C11 are formed between the resonant line 11*a* and an external conductor and between the resonant line 11*b* and the external conductor, respectively. In addition, an inter-line mutual capacitance C12 is defined between the resonant lines 11*a* and 11*b*. In FIGS. 8 to 10, the references are as follows:

Zin=input impedance

Ze (characteristic impedance in even mode)=$\sqrt{(\epsilon)}/(vc\times C_{11})$ where er: dielectric constant vc: velocity of light $C_{11}$: unit length self-capacitance (see FIG. 10)

$$Zk \text{ (coupling characteristic impedance)} = 2Ze \times Zo/(Ze - Zo) = \sqrt{(\epsilon r)/(vc \times C_{12})}$$

where Zo (characteristic impedance in odd mode)

$$= \sqrt{(\epsilon r)/vc(C_{11} + 2C_{12})}$$

$C_{12}$ = inter-line mutual capacitance (see FIG. 10)

$$\theta \text{ (phase angle)} = w\sqrt{(\epsilon r) \times L/vc}$$

here, $w$ (angular frequency) = $2\pi f$ $L$: resonant line length

In the FIG. 9 equivalent circuit, between the input (or output) and ground, the even mode characteristic impedance Ze is connected in parallel to the series circuit made up of the coupling characteristic impedance Zk and even mode characteristic impedance Ze.

Furthermore, FIG. 11 shows an input impedance characteristic of the one-stage BEF, and FIG. 12 illustrates an attenuation characteristic. In FIG. 12, the trap frequency fT is expressed in accordance with the following equation.

$$f_T = vc/4\sqrt{(\epsilon)}\times L$$

As seen in FIGS. 11 and 12, the impedance becomes zero at the trap frequency fT. This is because the reflective phase creates a short.

However, it is not possible to make an antenna coupler using a one-stage BEF having such a characteristic in a transmission or reception side. That is, as seen in FIG. 11, when viewed from the transmission side filter, for example, the impedance of the reception side filter becomes zero at the passband of the transmission side filter, so the signal does not flow to the antenna. The same problem may exist when the impedance of the transmission side filter becomes zero at the passband of the reception side filter.

For an antenna coupler by use of the one-stage BEF, as illustrated in FIG. 13, a phase-shifting line has conventionally been needed on either the transmission side TX or reception side RX. This increases the number of parts and, thereby, raises the cost of the antenna coupler.

SUMMARY OF THE INVENTION

It is therefore an object of the present invention to provide a dielectric filter small in size and small in number of parts concurrent with being excellent in productivity.

In accordance with an aspect of the present invention, there is provided a BEF type dielectric filter comprising plural one-stage band-elimination filters each composed of a pair of resonant lines inter-digitally coupled to each other and provided within one dielectric block so as to be phase-shifting-coupled to each other at an electrical angle of π/2 in an inter-digital or comb-line manner, wherein either an input resonant line or an output resonant line is provided which is phase-shifting-coupled to an input or output resonant line of the band-elimination filter type dielectric filter at an electrical angle of π/2 in an inter-digital or comb-line manner.

Further, in the BEF type dielectric filter, an open end of the resonant line is formed either at an end surface of the dielectric block, or in the vicinity of an opening of a resonant line hole, or at an opening end of the resonant line hole.

Thus, according to the present invention, there is provided an input or output resonant line phase-shifting-coupled at an electrical angle of π/2, to the input or output side of a BEF type dielectric filter made up of plural stages of two-resonant-line type BEFs, wherein the two resonant lines are inter-digitally coupled to each other. Therefore, if the dielectric filter according to this aspect of the invention is used in an antenna coupler, when viewed from the transmission side filter, for example, the impedance of the reception side filter becomes infinite at the passband of the transmission side filter. It is thus possible to use a dielectric filter integrally structured within a dielectric block for an antenna coupler.

The above and other objects, features, and advantages of the Invention will become more apparent from the following description when taken in conjunction with the accompanying drawings.

DESCRIPTION OF THE PREFERRED EMBODIMENTS

Figure 1:
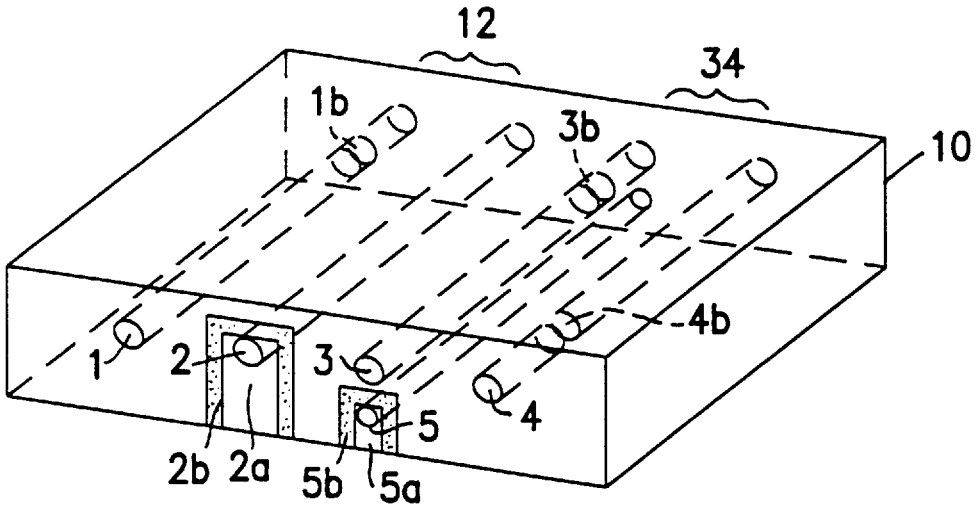
FIG. 1 is a perspective view showing a first embodiment according to this invention.

Referring now to FIG. 1, there is illustrated a two-stage BEF type filter according to a first embodiment of this invention. In FIG. 1, a rectangular dielectric block 10 has resonant line through-holes for four resonant lines 1 to 4 which are close to each other and extend from a first end surface to a second end surface which is positioned in opposed relation to the first end surface. In addition, under the resonant line 3 there is provided a resonant line through-hole for an output resonant line 5 which similarly extends from the first end surface of the dielectric block 10 to the second end surface thereof. The dielectric block 10 also has external conductors on its outer surfaces, and the respective resonant line through-holes include internal conductors. These external conductors and internal conductors are electrically connected to each other on the opposed end surfaces of the dielectric block 10 except for the case which will be described later.

That is, on the first end surface of the dielectric block 10, the internal conductors of the resonant lines 2, 5 are respectively connected to electrode terminals 2*a*, 5*a* electrically insulated from the external conductors by means of dielectric bare surfaces 2*b*, 5*b* and extending to the bottom surface. The internal conductor of the resonant line 4 is divided into two sections by a ring-like dielectric bare surface 4*b* positioned at the opening of the corresponding resonant line through-hole at the first end surface of the dielectric block 10 or in the vicinity thereof. Further, the internal conductors of the resonant lines 1, 3 are respectively divided into two sections by ring-like dielectric bare surfaces 1*b*, 3*b* located at the openings of the corresponding resonant line through-holes at the second end surface of the dielectric block 10 or in the vicinity thereof. These dielectric bare surfaces 2*b*, 5*b*, 1*b* and 3*b* make up open ends of the corresponding $\lambda/4$ resonant lines, respectively.

The resonant lines 1, 2 and resonant lines 3, 4 are inter-digitally coupled in pairs so as to define one-step BEFs 12, 34, respectively. Moreover, as illustrated in FIG. 2 these BEFs 12, 34 are inter-digitally coupled at an electrical angle ($\theta$) of $\pi/2$ between the resonant lines 2, 3 so as to finally establish a two-stage BEF type dielectric filter.

Figure 2:
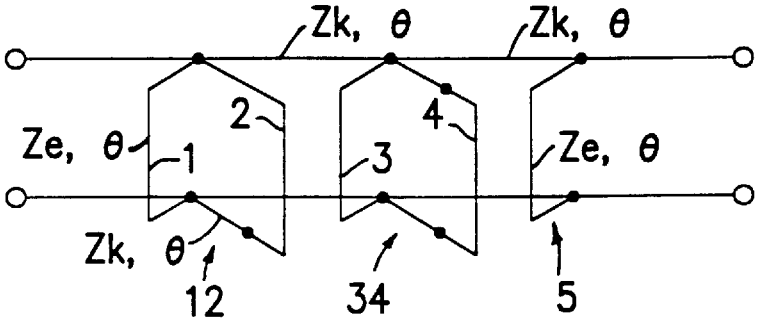
FIG. 2 is an illustration of an equivalent circuit of the first embodiment.

Since the resonant line 5 is similarly inter-digitally coupled to the resonant line 3 at an electrical angle ($\theta$) of $\pi/2$, the electrical equivalent circuit becomes as illustrated in FIG. 2. Accordingly, the output of the conventional example with no resonant line 5 is such that its impedance is in the vicinity of zero, while adding the resonant line 5 functioning as a $\pi/2$ phase shifter allows its output to be raised up to the vicinity of infinity. In addition, the electrode terminals 2*a*, 5*a* act as input and output terminals.

The BEF type dielectric filter according to the first embodiment also serves as a band-pass filter (BPF), having an attenuation characteristic except in the desired pass band, whereby it can be employed as a dielectric filter for an antenna coupler.

Figure 3:
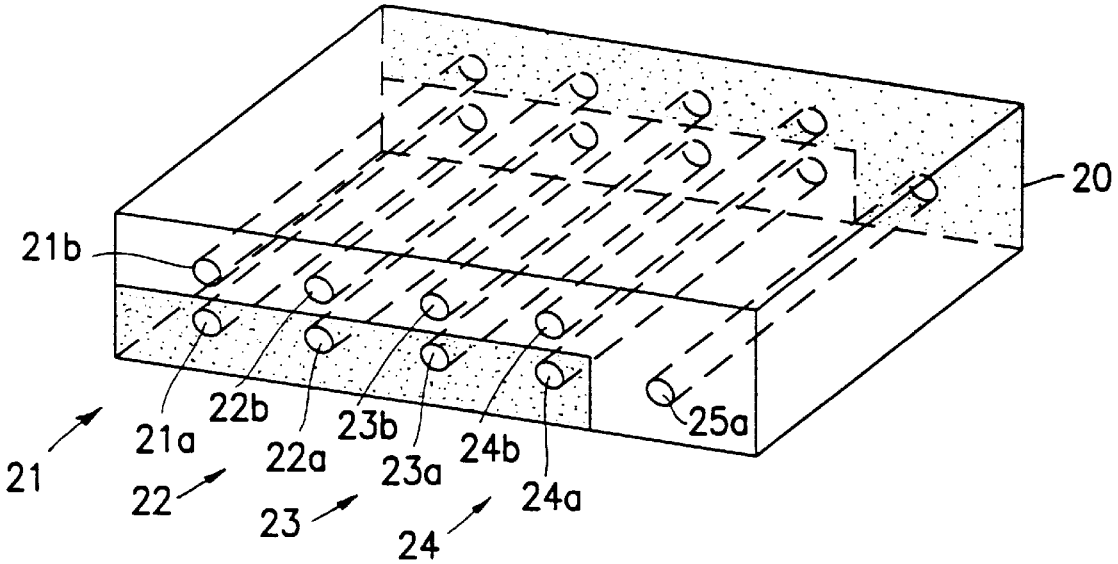
FIG. 3 is a perspective view showing a second embodiment according to this invention.

A second embodiment of this invention will be described with reference to FIG. 3. FIG. 3 illustrates a four-stage comb-line-coupled type BEF dielectric filter. In FIG. 3, numeral 20 denotes a rectangular dielectric block having therein cylindrical resonant line through-holes for forming resonant lines 21*a* to 25*a*, 21*b* to 24*b*, whose number is 9 in total, which extend from its first end surface to its second end surface positioned in opposed relation to the first end surface. The resonant line through-holes are closely arranged geometrically in 2 rows in the traverse direction and 5 rows in the longitudinal direction. The resonant line through-holes for the resonant lines 21*a* to 25*a* are placed in the lower row, and the resonant line through-holes for the resonant lines 21*b* to 24*b* are located in the upper row.

On the first end surface (the front surface in the illustration) of the dielectric block 20, the ends of the resonant lines 21*a* to 24*a* in the lower row are open ends, the resonant lines 21*b* to 24*b* in the upper row and the resonant line 25*a* in the lower row establish short-circuit ends. (The shaded surfaces in the FIG. 3 indicate bare dielectric material, while the unshaded surfaces indicate a conductive covering on the dielectric material.) Further, on the second end surface (the rear surface in the illustration) thereof, the resonant lines 21*a* to 24*a* in the lower row are short-circuit ends, and the resonant lines 21*b* to 24*b* in the upper row and the resonant line 25*a* in the lower row have open ends. The outer surfaces of the dielectric block 20, except for the open end planes just mentioned, are covered with external conductors. Moreover, internal conductors are provided in the resonant line through-holes for the resonant lines 21*a* to 25*a* and 21*b* to 24*b*.

The vertically paired resonant lines 21*a* and 21*b*, 22*a* and 22*b*, 23*a* and 23*b*, 24*a* and 24*b* are inter-digitally pair-coupled so as to constitute one-stage band-elimination filters (BEFs) 21, 22, 23, 24, respectively. The adjacent ones of these BEFs 21, 22, 23, 24 are comb-line-coupled to each other in a well-known manner.

Figure 4:
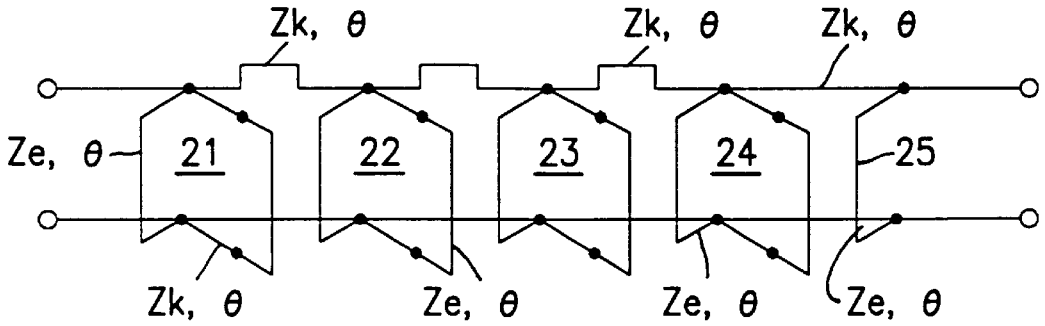
FIG. 4 is an illustration of an equivalent circuit of the second embodiment.

Being closely adjacent to the resonant line 24*a*, the resonant line 25*a* is inter-digitally coupled thereto at an electrical angle ($\theta$) of $\pi/2$. The input and output connections to the dielectric filter according to this embodiment are made by use of the resonant lines 21*a*, 25*a*. FIG. 4 illustrates an equivalent circuit. In FIG. 4, one-stage BEFs each comprising parallel branches made up of a series connection of (Ze, $\theta$) and (Zk, $\theta$) and parallel branches made up of (Ze, $\theta$) are connected through a (Zk, $\theta$) short transmission line.

The effects of this second embodiment are the same as the above-described first embodiment, and therefore the description thereof will be omitted for brevity.

Figure 5:
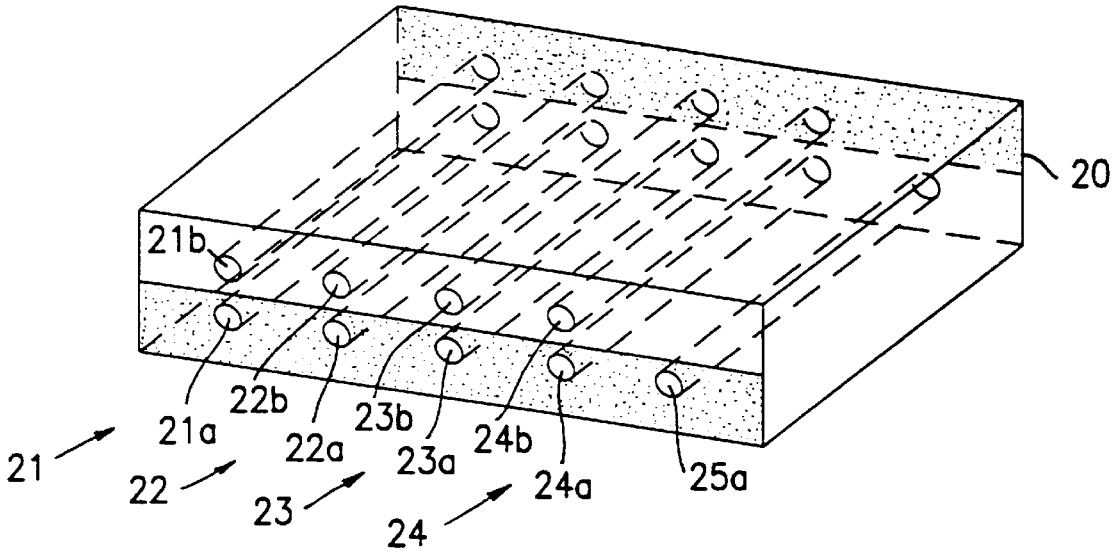
FIG. 5 is a perspective view showing a third embodiment according to this invention.
Figure 6:
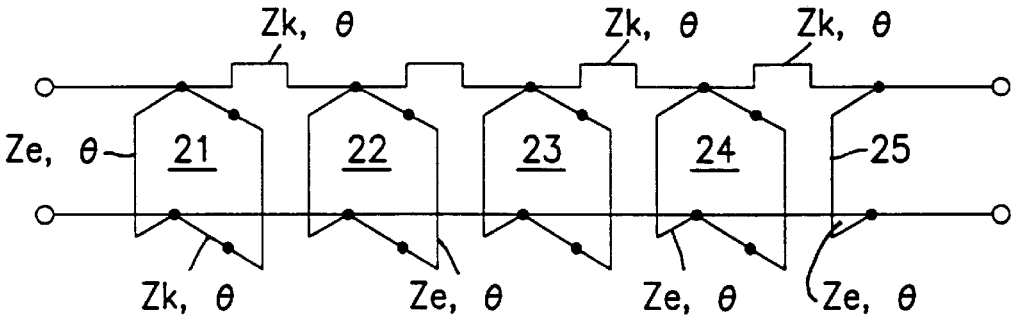
FIG. 6 is an illustration of an equivalent circuit of the third embodiment.
Figure 7:
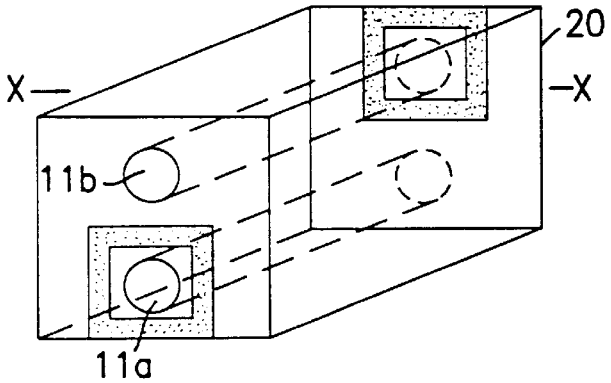
FIG. 7 PRIOR ART
FIG. 7 is a perspective view showing a conventional example of a BEF-type dielectric filter.
Figure 8:
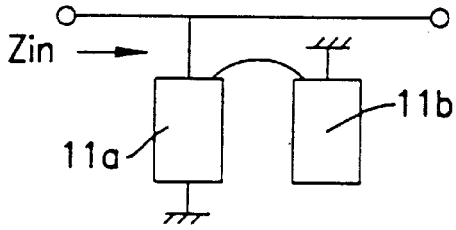
FIG. 8 PRIOR ART
FIG. 8 is an illustration of a circuit arrangement of the conventional example.
Figure 9:
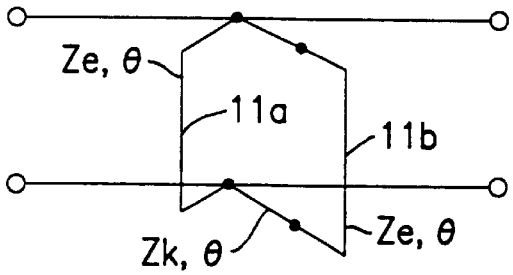
FIG. 9 PRIOR ART
FIG. 9 is an illustration of an equivalent circuit of the conventional example.
Figure 10:
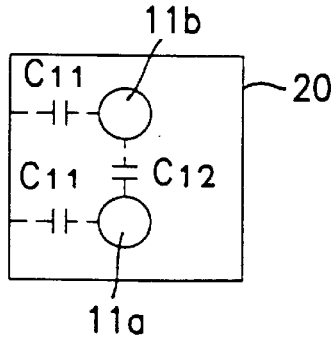
FIG. 10 PRIOR ART
FIG. 10 is a cross-sectional view, taken along line X—X of FIG. 7, for illustrating the structure of the equivalent circuit.
Figure 11:
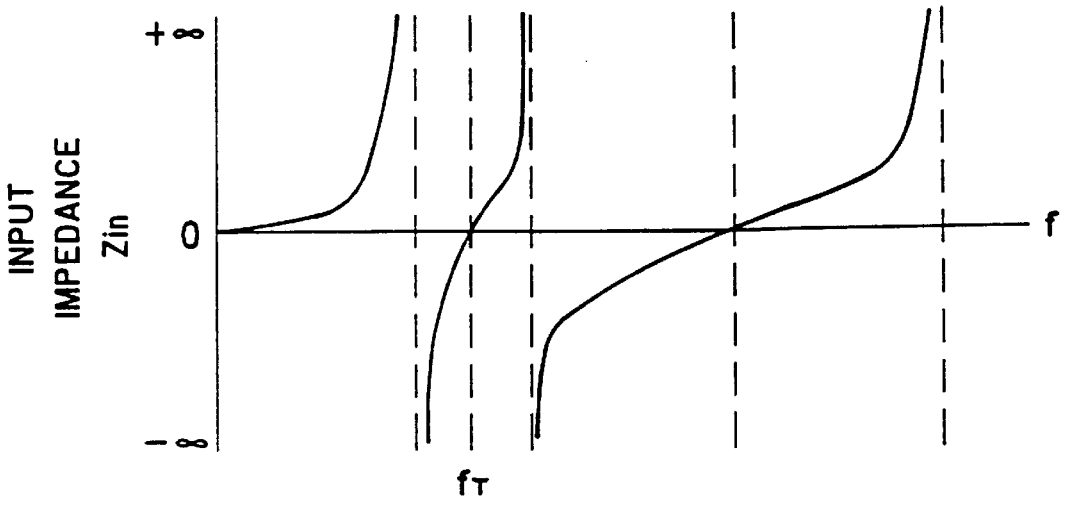
FIG. 11 PRIOR ART
FIG. 11 is an illustration of an input impedance characteristic of the conventional example.
Figure 12:
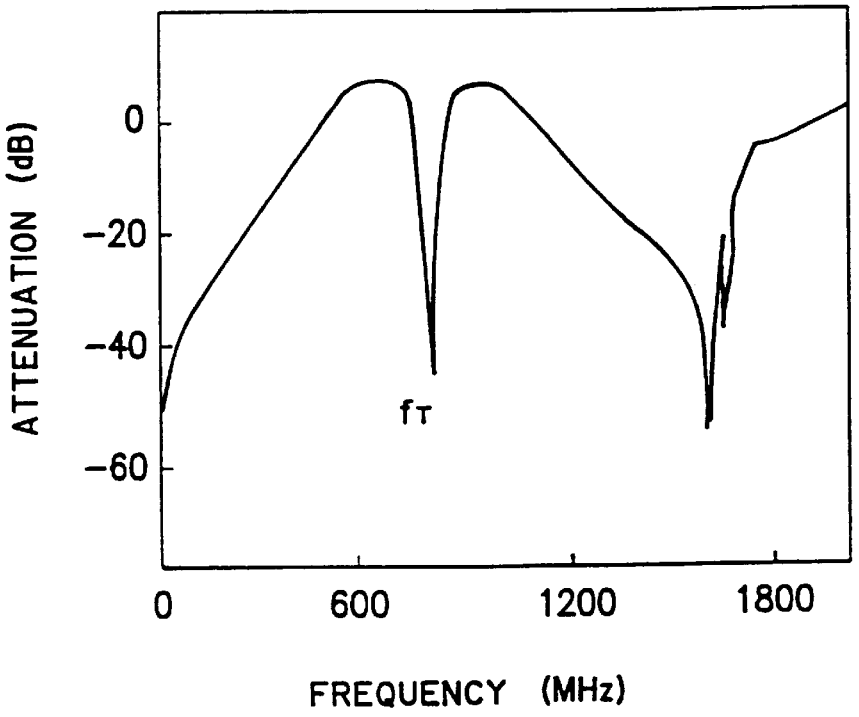
FIG. 12 PRIOR ART
FIG. 12 shows an attenuation characteristic of the conventional example.
Figure 13:
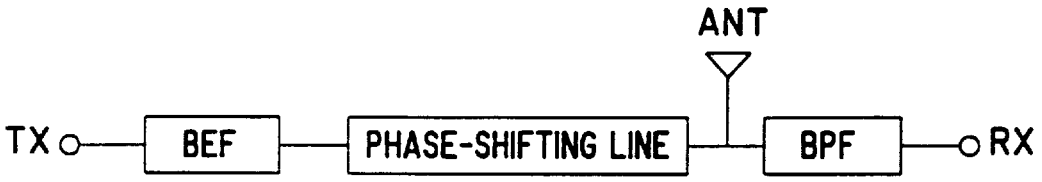
FIG. 13 PRIOR ART
FIG. 13 shows a circuit arrangement of an antenna coupler utilizing the conventional BEF-type dielectric filter.

A third embodiment will be described with reference to FIG. 5. The only difference between the third embodiment in FIG. 5 and the second embodiment in FIG. 3 is that a final-stage resonant line 24*a* and output resonant line 25*a* are comb-line-coupled to each other at a phase angle ($\theta$) of $\pi/2$, and hence the same reference numerals are given to parts corresponding to those in the second embodiment and the description thereof is omitted. FIG. 6 shows an equivalent circuit of the third embodiment. The effects of this third embodiment are the same as the above-described first embodiment, and therefore the description thereof will be omitted for brevity.

Although in the above described embodiments the output resonant line functioning as a $\pi/2$ phase shifter is added to only the output side of the dielectric filter, it would also be appropriate for this resonant line acting as the $\pi/2$ phase shifter to be added to the input side of the dielectric filter. In addition, unless otherwise shown, well-known input/output structures are usable with the invention.

According to this invention, in addition to the two resonant lines inter-digitally pair-coupled to each other so as to compose a BEF in a dielectric block, there is also provided an input or output resonant line phase-shifting-coupled at an electrical angle of $\pi/2$. Thus, the impedance of the reception side filter has a value of infinity at the passband of the transmission side filter, for example, whereby the dielectric filter integrally structured in a dielectric block can be used for an antenna coupler.

Moreover, since the resonant lines for the BEFs, the input/output resonant line for the $\pi/2$ phase-shifting coupling, and the other structures mentioned above are integrally formed within one dielectric block, it is possible to reduce the size and the number of parts, so as to improve productivity. Further, it is possible to manufacture the filter by means of a molding process, thus attaining high dimensional accuracy, providing uniform electrical characteristics, and obtaining a higher yield, thereby further reducing the production cost.

It should be understood that the foregoing relates to only a preferred embodiment of the invention, and that it is intended to cover all changes and modifications of the embodiment of the invention herein used for the purpose of the disclosure, which do not constitute departures from the spirit and scope of the invention.

What is claimed is:

1. A band-elimination filter type dielectric filter comprising:

a plurality of one-stage band-elimination filters each composed of a pair of resonant lines inter-digitally coupled to each other, said plurality of one-stage band-elimination filters being spaced apart from each other within one dielectric block, and coupled to each other with phase-shift at an electrical angle of $\pi/2$, and an additional input/output resonant line which is coupled to a selected resonant line of said plurality of one-stage band-elimination filters with phase-shift at an electrical angle of $\pi/2$.

2. A filter as defined in claim 1, wherein said plurality of one-stage band-elimination filters are inter-digitally coupled to each other.

3. A filter as defined in claim 1, wherein said plurality of one-stage band-elimination filters are comb-line coupled to each other.

4. A filter as defined in claim 1, wherein said additional input/output resonant line and said selected resonant line are inter-digitally coupled to each other.

5. A filter as defined in claim 1, wherein said additional input/output resonant line and said selected resonant line are comb-line coupled to each other.

6. A band-elimination filter type dielectric filter as defined in claim 1, wherein an open end of said additional input/output resonant line is located at an end surface of said dielectric block.

7. A band-elimination filter type dielectric filter as defined in claim 1, wherein an open end of said additional input/output resonant line is located spaced away from an opening of a resonant line hole thereof.

8. A band-elimination filter type dielectric filter as defined in claim 1, wherein an open end of said additional input/output resonant line is located at an opening of a resonant line hole thereof.

* * * * *